US011071180B2

(12) United States Patent
Arulandu et al.

(10) Patent No.: US 11,071,180 B2
(45) Date of Patent: Jul. 20, 2021

(54) LIGHTING UNIT AND DRIVING METHOD

(71) Applicant: SIGNIFY HOLDING B.V., Eindhoven (NL)

(72) Inventors: Karnekumar Arulandu, Eindhoven (NL); Aleksandar Sevo, Eindhoven (NL); Johannes Maria Van Meurs, Eindhoven (NL); Cornelis Antonius Verbakel, Eindhoven (NL)

(73) Assignee: Signify Holding B.V., Eindhoven (NL)

( * ) Notice: Subject to any disclaimer, the term of this patent is extended or adjusted under 35 U.S.C. 154(b) by 0 days.

(21) Appl. No.: 16/982,556

(22) PCT Filed: Mar. 25, 2019

(86) PCT No.: PCT/EP2019/057422
§ 371 (c)(1),
(2) Date: Sep. 19, 2020

(87) PCT Pub. No.: WO2019/185540
PCT Pub. Date: Oct. 3, 2019

(65) Prior Publication Data

US 2021/0007193 A1 Jan. 7, 2021

(30) Foreign Application Priority Data

Mar. 29, 2018 (EP) ..... 18165208

(51) Int. Cl.

| | |
|---|---|
| ***H05B 45/14*** | (2020.01) |
| ***H05B 45/50*** | (2020.01) |
| ***H05B 45/397*** | (2020.01) |
| ***H05B 45/3725*** | (2020.01) |

(52) U.S. Cl.
CPC ..... *H05B 45/14* (2020.01); *H05B 45/3725* (2020.01); *H05B 45/397* (2020.01); *H05B 45/50* (2020.01)

(58) Field of Classification Search
None
See application file for complete search history.

(56) References Cited

U.S. PATENT DOCUMENTS

| | | | | |
|---|---|---|---|---|
| 2010/0181936 | A1 | 7/2010 | Radermacher et al. | |
| 2011/0080110 | A1 | 4/2011 | Nuhfer et al. | |
| 2012/0299489 | A1 | 11/2012 | Sakuragi et al. | |
| 2013/0313991 | A1* | 11/2013 | Pan | H05B 45/395 315/201 |
| 2014/0368204 | A1 | 12/2014 | Siessegger et al. | |

(Continued)

FOREIGN PATENT DOCUMENTS

EP 2793534 A1 10/2014

*Primary Examiner* — Anh Q Tran
(74) *Attorney, Agent, or Firm* — Daniel J. Piotrowski

(57) ABSTRACT

A lighting unit which includes a driver, a light source and a buffer capacitor of an auxiliary circuit (such as an independent active electronic circuit). The charging current allowed to flow to the buffer capacitor is controlled based on sensed currents flowing to the light source thereby to control the charging current of the buffer capacitor. In this way, large inrush currents caused by the use of a large buffer capacitor at the output of the driver can be avoided and the triggering of a fault detection mode within the driver can be prevented. Furthermore this circuit ensures that the driver is operated within the specification limits during start-up.

15 Claims, 3 Drawing Sheets

(56) References Cited

U.S. PATENT DOCUMENTS

| | | | | |
|---|---|---|---|---|
| 2015/0271882 | A1 | 9/2015 | Melanson et al. | |
| 2015/0305098 | A1* | 10/2015 | Jung | H05B 45/48 315/122 |
| 2017/0063076 | A1 | 3/2017 | Hou et al. | |
| 2019/0110346 | A1* | 4/2019 | Xu | H05B 45/36 |

* cited by examiner

LIGHTING UNIT AND DRIVING METHOD

CROSS-REFERENCE TO PRIOR APPLICATIONS

This application is the U.S. National Phase application under 35 U.S.C. § 371 of International Application No. PCT/EP2019/057422, filed on Mar. 25, 2019, which claims the benefit of United European Patent Application No. 18165208.2, filed on Mar. 29, 2018. These applications are hereby incorporated by reference herein.

FIELD OF THE INVENTION

This invention relates to lighting units which include a lighting driver and a light source, and in which the lighting driver is additionally used to power one or more additional modules.

BACKGROUND OF THE INVENTION

LED drivers are very suitable for adding functions and features, such as coded light injection and emergency lighting, to the main light output function. This is because LED drivers already convert a mains ac input voltage to a dc voltage, which is then suitable for driving additional modules.

As new technologies such as the Internet of Things emerge for the lighting industry, there is also a desire to add these new features to mainstream luminaires. Such additional features may be implemented by additional modules, which are provided as add-on circuits which require an auxiliary power supply.

This auxiliary power supply may be obtained by converting the lower dc output voltage of the LED driver into the required auxiliary supply voltage. Tapping power from the output of the LED driver is a cost-effective approach, but there is a problem that conventional LED drivers are optimized for cost and efficiency such that connecting anything else but a passive LED load may result in compatibility issues with the LED driver. Generally, when a large capacitor (in the range of tens or hundreds of micro Farads) is connected to the output of a typical LED driver, the LED driver may detect a fault condition (in particular the presence of an output current at power up when none is expected from the passive LED load for which the driver is designed), and then assert a short circuit protection mode.

One example of possible additional module is a coded light injector, as mentioned above. This takes the form of a modulator interposed between the LED driver and the LED board to inject coded light modulation. It has been found that many LED drivers fail to start up due to the large buffer capacitor in the coded light injector. This buffer capacitor needs to be quite large in order to minimize power losses in the modulator and to minimize the influence of the modulation current on the LED driver.

There is therefore a need for a lighting unit which allows additional modules to be powered by the driver.

SUMMARY OF THE INVENTION

The invention is defined by the claims.

According to examples in accordance with an aspect of the invention, there is provided a lighting unit, comprising:

a light source;

a driver for driving the light source which provides an output current between first and second terminals;

a first current sensing element in series with the light source between the first and second terminals;

an auxiliary circuit for powering by the driver, which auxiliary circuit comprises a buffer capacitor;

a second current sensing element and a control switch in series with the buffer capacitor between the first and second terminals; and a controller adapted to control the control switch in dependence on the currents sensed by the first and second current sensing elements thereby to control the current flowing to the buffer capacitor.

The lighting unit has the light source and a buffer capacitor of an auxiliary circuit in separate parallel paths, so that they are both driven by the output from the driver. To allow a large buffer capacitor to be used, the current flowing through the buffer capacitor is managed. This is particularly important during start-up, when a capacitor charging current would flow even before the output voltage reaches the light source forward voltage. The controller functions as an inrush current limiter. By suitable control of the current that is allowed to flow, it can be ensured that there is fast charging of the buffer capacitor while at the same time preventing the driver from operating beyond its output current and/or voltage limits and associated time constraints.

The light source is typically an LED load. The aim of the circuit control is to make the load and current characteristics at the output of the driver during start up emulate those that would be present for a basic LED load. For example, when the LED load does not draw current, a charging current to the buffer capacitor is inhibited, and the driver current is shared between the buffer capacitor and the light source during buffer capacitor charging.

The lighting unit for example comprises a current mirror circuit for comparing the currents sensed by the first and second current sensing elements. The current allowed to pass through the buffer capacitor may then be selected in dependence on the current through the light source. In this way, the driver current is shared between the light source and the buffer capacitor and it is prevented that overcurrent is detected by the driver.

The controller is for example adapted to control the current through the buffer capacitor during initial charging to be a fixed multiple of the current through the light source. This means the ratio between the buffer capacitor charging current and the light source current is controlled. Current flow may also be inhibited through the buffer capacitor while there is no light source current.

The ratio may be unity, so that the current through the buffer capacitor during initial charging is controlled to be equal to the current through the light source. However, other ratios are possible, and the ratio dictates the speed of buffer capacitor charging.

The lighting unit may be adapted to switch on the control switch when the initial charging is complete. This may be achieved by the controller or there may be dedicated circuit components for this purpose. In this way, once the buffer capacitor is charged, so that the potential problem of large inrush currents has passed, the buffer capacitor may then be kept charged in conventional manner using the output of the driver.

The current sensing elements for example comprise current sense resistors. A voltage across the resistor is indicative of the current flowing, and the lighting unit may then make use of these voltages to control the control switch. The control switch for example comprises a transistor, wherein the signal for the control terminal (e.g. gate) is provided by the controller.

The buffer capacitor for example has a capacitance greater than 10 μF, for example greater than 100 μF, for example greater than 200 μF, for example greater than 400 μF. This is a sufficient size to provide a stable auxiliary power supply, and hence also sufficiently large to present possible current inrush problems.

As mentioned above, the driver for example comprises a protection system for shutting down in response to a detected driver output open circuit or short circuit condition. The invention avoids this protection shut down to be caused by initial charging of the buffer capacitor. The driver for example comprises a switch mode power converter.

The invention also provides a method of driving a lighting unit, comprising:

using a driver to deliver an output current between first and second terminals;

sensing a portion of the output current through a light source of the lighting unit;

sensing a portion of the output current through a buffer capacitor of an auxiliary circuit; and controlling a control switch in series with the buffer capacitor in dependence on the currents sensed thereby to control the current flowing to the buffer capacitor.

This method enables inrush currents to be limited.

The method may comprise controlling the current through the buffer capacitor during initial charging to be a fixed multiple of the current through the light source for example equal to the current through the light source.

The method may comprise switching on the control switch when the initial charging is complete. The method preferably also comprises providing protection for shutting down the driver in response to a detected driver output open circuit or short circuit condition.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

Figure 1:
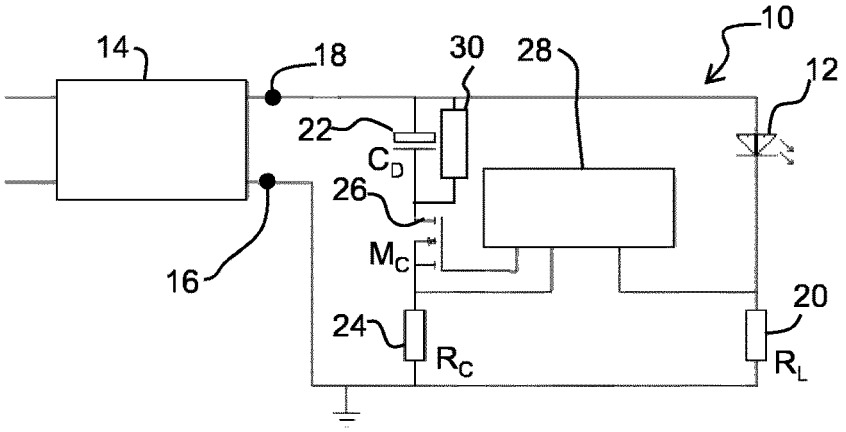
FIG. 1 shows a lighting unit in schematic form.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a lighting unit which includes a driver, a light source and a buffer capacitor of an auxiliary circuit (such as an independent active electronic circuit). The charging current allowed to flow to the buffer capacitor is controlled based on sensed currents flowing to the light source thereby to control the charging current of the buffer capacitor. In this way, large inrush currents caused by the use of a large buffer capacitor at the output of the driver can be avoided and the triggering of a fault detection mode within the driver can be prevented. Furthermore this circuit ensures that the driver is operated within the specification limits during start-up.

FIG. 1 shows a lighting unit 10 comprising a light source 12 such as a set of LEDs in series, and a driver 14 for driving the light source and which provides an output current between first and second terminals 16, 18. The first terminal 16 is ground and the second terminal is at a DC bus voltage, for example between 20V and 100V, which depends on the characteristics of the LED load.

A first current sensing element 20 ($R_L$), in particular a current sense resistor, is in series with the light source 12 between the first and second terminals 16, 18. This forms a first branch.

There is a second branch in parallel with the first branch, which comprises a buffer capacitor 22 ($C_D$), a second current sensing element 24 ($R_C$), in particular a second current sense resistor, and a control switch 26 ($M_C$), in particular a MOS transistor, in series with the buffer capacitor.

The buffer capacitor is part of an auxiliary circuit, and it functions as a power supply for that auxiliary circuit. The buffer capacitor provides a smoothed DC auxiliary power supply, and the remainder of the auxiliary circuit is shown as module 30 in parallel with the buffer capacitor. The buffer capacitor has a second function of smoothing the load variations of the load (30) towards the LED driver.

Note that the buffer capacitor may be the full auxiliary circuit, so that the auxiliary circuit then is an auxiliary power supply to which additional modules may or may not then be connected.

A controller 28 controls the control switch 26 in dependence on the currents sensed by the first and second current sensing elements thereby to control the total current delivered by the driver.

The driver is designed to deliver a constant current to its load. The output voltage of the driver will ramp up at a rate which is dependent on an internal output capacitance of the driver, until it reaches the forward voltage of the LEDs. A certain voltage slope is expected by the driver for a known LED output load. A driver with a smaller output capacitance will have a higher voltage slope (because $I=C\cdot dv/dt$) at start-up. Compatibility issues can arise when the output load is changed, for example by adding the auxiliary circuit. The driver measures and controls the output current to a fixed value, and is designed to be operated only with a passive LED load.

The protection function implemented in the driver is intended to prevent damage to the driver in the event of a no-load condition at the output, or a short circuit condition at the output. In the no-load condition, the output voltage of the LED driver should not exceed a specified limit as stated in the datasheet of the driver. In the short circuit condition, the driver detects that the output already conducts current at very low output voltages (which is not expected for an LED load, as a result of the forward voltage). At start-up, a large peak current at a relatively long duration may be observed when a buffer capacitor is presented, compared to the start-up without the capacitor.

An integral current value over a start-up time period may also be used as a measure to assert a short circuit protection.

The addition of a capacitive load generally changes the voltage and current characteristics during initial start-up, for example since any output voltage will result in a capacitor charging current.

To allow a large buffer capacitor to be used, the current flowing through the buffer capacitor is managed. This is particularly important during start-up, when a large capacitor charging current would flow immediately upon application of a voltage. The controller 28 thus functions as an inrush current limiter. By suitable control of the current that is allowed to flow, it can be ensured that there is fast charging of the buffer capacitor and hence readiness of the auxiliary power supply, while at the same time preventing the driver from operating beyond its output current (e.g. integrated current) and/or voltage limits.

The basic operation of the circuit will first be described with reference to the schematic circuit diagram of FIG. 1, before a more detailed circuit implementation is provided.

When the driver is powered up, the buffer capacitor 22 is depleted and the output voltage of the LED driver starts to increase.

The control transistor 26 is in a non-conduction state as the controller 28 is not yet powered up. As soon as LED driver output voltage is high enough to activate the controller 28, the controller regulates the gate signal to the control transistor 26 such that the charging current sensed through the second current sensing element 24 is maintained at a fixed value relative to the LED current sensed by the first current sensing element 20. By way of example, the two currents may be controlled to be equal.

The current through the LEDs of the light source 12 is zero until the LED driver voltage becomes equal to the forward voltage of the LED arrangement. Until then, the sensed LED current is zero and the capacitor charging current is kept at zero as it is regulated to be equal to (or more generally in proportion with) the capacitor charging current.

Thus, the capacitor charging current is inhibited during initial ramping of the output voltage before the controller is powered, and even after the controller is powered but the LED forward voltage has not been reached.

When the driver output voltage has increased to the forward voltage of the light source 12, the resulting LED current is sensed, and the controller regulates the gate of the control transistor 26 such that the fixed driver output current is distributed between the light source 12 and the buffer capacitor 22. This takes place during an initial charging phase of the capacitor.

The driver may have a ramped output current up to the fixed level or it may have a stepped output current.

The need for the current control will depend on the type of driver. Some constant current drivers may be able to tolerate the presence of the buffer capacitor as they have the ability to regulate the current at low output voltages. This may apply to fly-back converter and buck-converter stages. Resonant converters e.g. LLC, LCC or forward converters have more stringent limitations with respect to the output voltage range. When a large depleted capacitor is directly applied to the output and the driver is powered up, excessive output currents can be observed. As explained above, these high inrush currents and their timing may assert protection within the LED driver such that the driver fails to start up.

The ratio between the LED current and the buffer capacitor charging current can be set by the ratio of the current sense resistors 20, 24. At the end of the initial charging phase, the gate signal provided by the controller 28 continues to increase. However, as the buffer capacitor is charged by this point, the charging current drops, whereas the LED current continues to increase. The controller continues to increase the gate drive signal for the control transistor 26 further until the control transistor 26 is fully turned on, and hence operating in a saturation mode.

The charging process of the capacitor has then been completed. From this point, the control transistor 26 remains in the saturated mode, because the average current through the LEDs of the light source 12 will always be higher than the ripple current flowing through the buffer capacitor.

An additional load can be in parallel across buffer capacitor 22 or between the terminals 16 and 18. The load should have a sufficient impedance that it does not limit the output voltage of the LED driver to be lower than the minimum specification limit of the LED driver, especially during start-up.

After a new power cycle, even when the capacitor is partially charged, the capacitor will only be charged when the driver output voltage is sufficient to power up the LEDs.

By this arrangement, it can be ensured that the LED driver will always be operated within its operating window.

Figure 2:
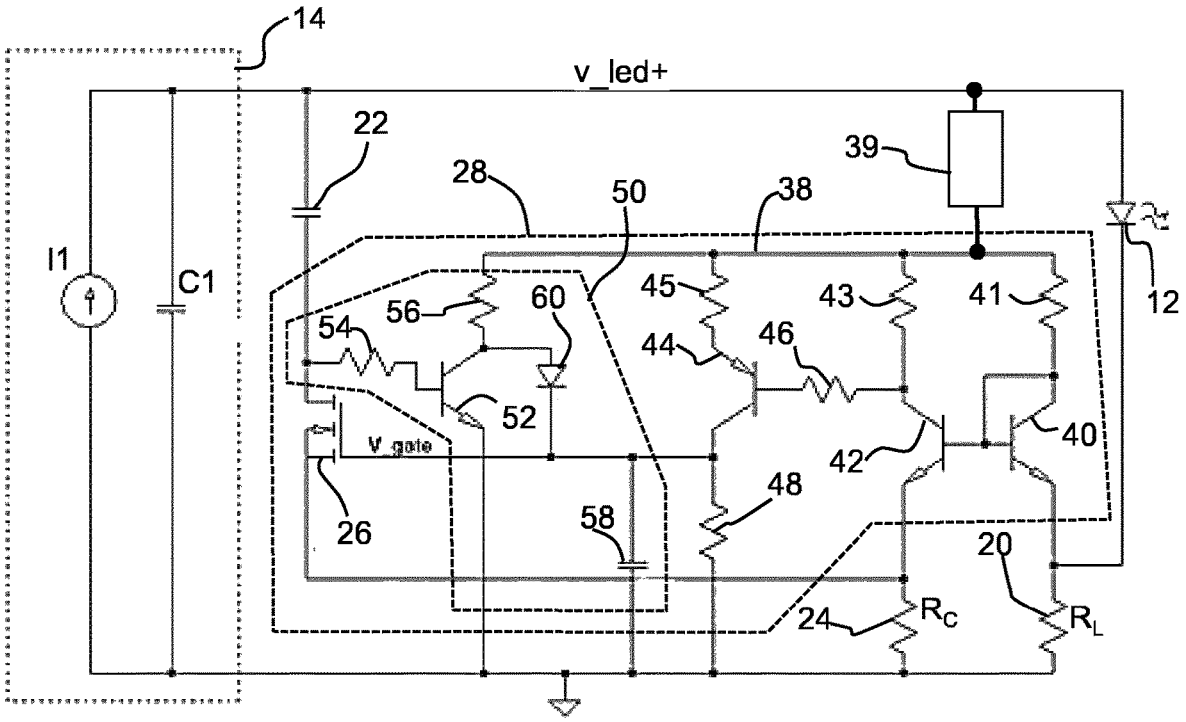
FIG. 2 shows the circuit of the lighting unit of FIG. 1 in more detail.

A practical implementation of the circuit is shown in FIG. 2, in which the controller 28 is implemented in analogue form as a circuit arrangement, having a voltage supply rail 38 and a ground line.

The voltage supply rail 38 is supplied from the main driver output (V_led+) by means of a dc-dc converter, or by a linear voltage regulator, or a divider circuit. These options are shown generically by unit 39.

The driver 14 is represented by a constant current source I1 with a parallel capacitor C1.

The first and second current sense resistors 20, 24 form part of a current mirror circuit comprising a first branch of a transistor 40 in series with the current sense resistor 20 and a first bias resistor 41, between the voltage supply rail 38 and ground. A second branch is formed by a transistor 42 in series with the current sense resistor 24 and a second bias resistor 43, between the voltage supply rail 38 and ground.

The light source current sets a voltage across the current sense resistor 20. The first current sense resistor 20 is orders of magnitude smaller than the bias resistor 41 (e.g. 40 mΩ compared to 33 kΩ) so that the current and hence voltage is dominated by the light source. Similarly, the second current sense resistor 24 is orders of magnitude smaller than the bias resistor 43 (e.g. 40 mΩ compared to 5.6 kΩ) so that the current and hence voltage is dominated by the current flowing through the buffer capacitor.

The default base driver current is provided by the resistor 41. When the current through current sense resistor 20 is less than through the current sense resistor 24, the transistor 42 does not conduct, and when the current through current sensor resistor 20 is more than through current sense resistor 24, the transistor 42 will conduct and activate a transistor 44 (which has an emitter resistor 45 and a base resistor 46). The transistor 44 is connected between the supply rail 38 and the gate of the control transistor 26. Thus, when transistor 44 is turned on, a gate drive voltage is applied as signal V_gate.

When the LED current increases, the drive current through transistor 42 will also increase, and as a consequence the collector current will increase. This will result in a higher base drive current to the transistor 44 and thus there will be an increased gate voltage to the control transistor 26. This increased gate drive of control transistor 26 increases the source-drain current, thereby charging the buffer capacitor 22 and increasing the current through the second current sense resistor 24.

The base and collector current through transistor 42 will continue to increase until the current through the second current sense resistor 24 is equal (in this example) to the current through the first current sense resistor 20.

A discharge resistor 48 is connected between the gate of the control transistor 26 and ground and it ensures that the gate drive signal is discharged when current supply through the transistor 44 is reduced or when the driver has been switched off.

Thus, the overall operation of the circuit as described so far is to compare the current flowing through the light source with the current flowing through the buffer capacitor. A feedback control circuit controls the gate of the control transistor 26 to regulate the current flowing through the buffer capacitor and maintain the current source current and the buffer capacitor equal (or more generally with a predetermined relationship between them) while the buffer capacitor is being charged.

When the circuit is first activated, there is no voltage on the voltage supply rail 38.

For this reason, a start-up circuit 50 is provided to ensure correct start-up operation of the circuit, in particular to make sure the control transistor 26 is off. It comprises a transistor 52 with base resistor 54 and collector resistor 56. It is connected between the voltage supply rail 38 and ground. When there is no voltage across the buffer capacitor 22, the transistor 52 is turned on by the driver output. A capacitor 58 is connected between the gate of the control transistor 26 and ground, and in addition a diode is connected in a forward direction from the collector of the transistor 52 to the gate of the control transistor 26.

When the driver is powered up and the capacitor is depleted, the initial voltage of the driver will activate transistor 52 through the base resistor 54. The transistor 52 has its emitter pulled to ground and this prevents the capacitor 58 from charging through the resistor 56 and diode 60, and hence initially keeps the control transistor 26 turned off.

Once the buffer capacitor 22 is fully charged, the voltage at the base of transistor 52 will be low and it will be turned off. The gate of the control transistor 26 will be charged from the voltage supply rail 38 through resistor 56 and diode 60. This maintains the transistor 22 fully turned on.

During normal operation, the light source current exceeds the buffer capacitor current, so the circuit plays no role during this time and the transistor 22 remains turned fully on. Thus, the start-up circuit 50 ensures the circuit operation before the auxiliary circuit has power available and makes sure that transistor 26 is turned fully on after the inrush sequence.

Figure 3:
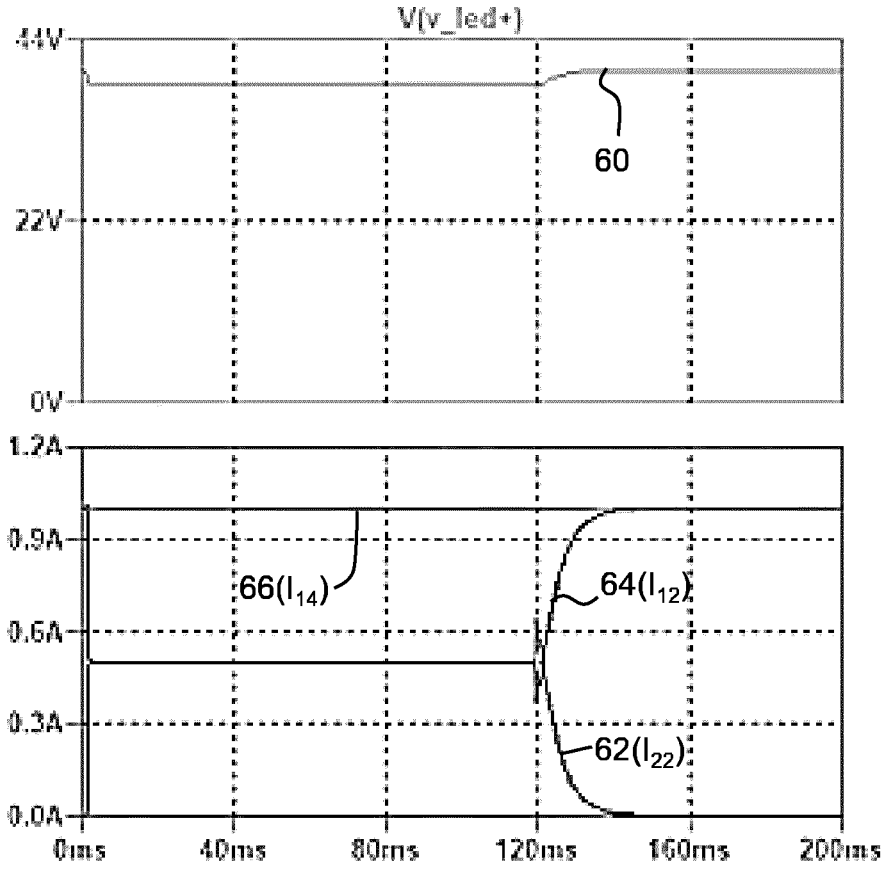
FIG. 3 shows a first example set of waveforms to explain the operation of the lighting unit.

FIG. 3 shows simulation results to illustrate the operation of the circuit.

The top image shows the output voltage of the driver (v_led+ shown in FIG. 2) as plot 60.

The bottom image shows the current through the buffer capacitor as plot 62 ($I_{22}$), the light source current as plot 64 ($I_{12}$) and the driver output current as plot 66 ($I_{14}$).

At time t=0 the LED driver output voltage and LED current have an initial peak. Shortly thereafter, the light source current drops to approximately half of the LED driver current while the charging current of the buffer capacitor increases to approximately half the LED driver current.

In practice, there is always at least a small capacitor internally at the output of the driver which results in a positive voltage slope of the LED driver output voltage, which thus causes the LED current to gradually increase (at a rate depending on the output capacitor of the LED driver). The circuit equally distribute this driver current between a buffer capacitor charging current and an LED current, as explained above.

From this point onwards, the capacitor is charged. The duration of this period depends mainly on the buffer capacitor value, the overall driver current and the forward voltage of the LEDs of the light source 12.

Once the capacitor is approaching full charge, at 120 ms in this example, the capacitor charging current decreases and the current though the light source increases until approximately 140 ms. From 140 ms onwards, the capacitor is fully charged and the transistor 22 is in full conduction mode. The inrush process has been completed.

Figure 4:
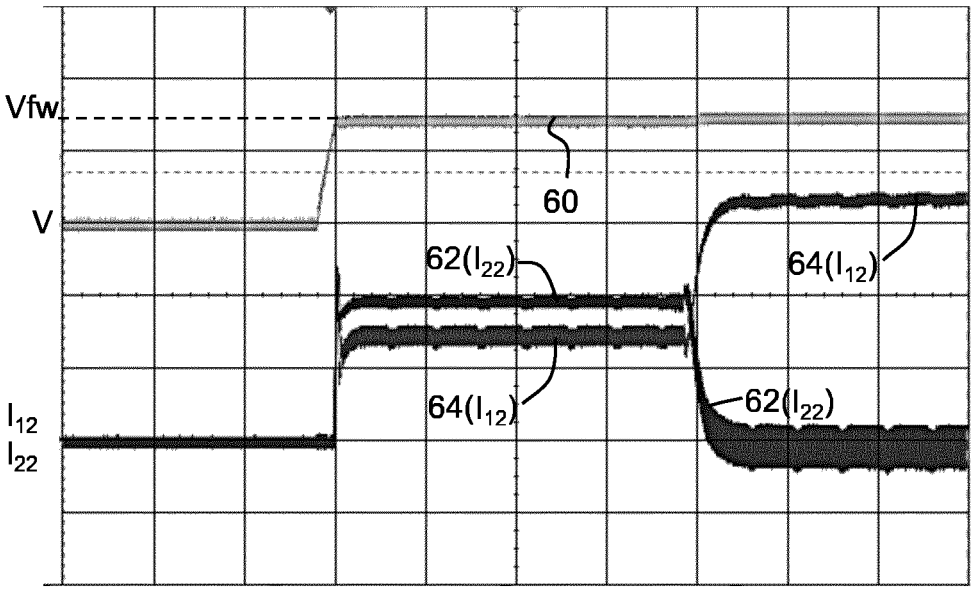
FIG. 4 shows a second example set of waveforms to explain the operation of the lighting unit.

FIG. 4 shows an actual measurement result from the circuit shown. The same references are used as in FIG. 3.

At start-up, the driver output voltage (plot 60) reaches the forward string voltage Vfw of the LEDs before current starts to be withdrawn from the LED driver (plot 64). When the output voltage of the LED driver reaches the forward voltage of the LEDs, the current through the LEDs and the charging current of the buffer capacitor are almost equal (the LED current is slightly lower). Finally, when the charging process has been completed, the charging current of the buffer capacitor (plot 62) drops to zero and the light source current (plot 64) increases to the driver current.

By charging the buffer capacitor in this way, at power up, the driver is directly operated within the operating window, even though a large buffer capacitor is present at the output. Furthermore, charging is done rapidly and the charging current is automatically adapted to half of the LED current such a single circuit is applicable for a wide range of LED drivers and LED board combinations with different voltage and current ranges.

The buffer capacitor for example has a capacitance greater than 10 μF, for example greater than 100 μF, for example greater than 200 μF, for example greater than 400 μF. This is a sufficient size to provide a stable auxiliary power supply and also to prevent load fluctuations from becoming visible within the LED driver. It is however also sufficiently large to present possible current inrush problems.

Examples of circuit 30 which may draw power from the voltage across the buffer capacitor are:

a coded light modulator;

an emergency lighting battery charging circuit;

an IPS modulator (indoor positioning system) light modulation circuit;

a LiFi circuit (high speed visible light communication circuits) e.g. auxiliary supplies for digital and analog front ends (power injector, photo diode, LED modulation power, infra red LED power supply).

Figure 5:
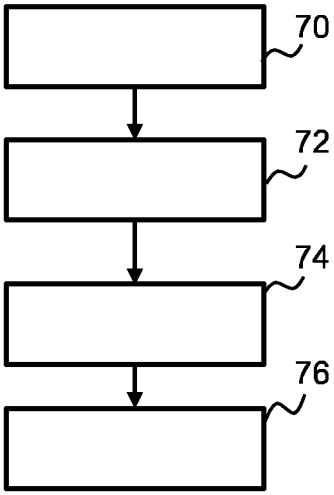
FIG. 5 shows a method of controlling a lighting unit.

FIG. 5 shows a method of driving a lighting unit, comprising:

in step 70, using a driver to deliver an output current between first and second terminals;

in step 72, sensing a portion of the output current through a light source of the lighting unit;

in step 74, sensing a portion of the output current through a buffer capacitor of an auxiliary circuit; and in step 76, controlling a control switch in series with the buffer capacitor in dependence on the currents sensed thereby to control the current flowing to the buffer capacitor.

This method in particular controls the division between a buffer capacitor charging current and a light source current, so that excessive inrush currents can be prevented, thereby ensuring that the driver output current and voltage remain within specification limits. This means the expected lifetime of the LED driver can be maintained.

The example above makes use of a controller in the form of an analogue circuit to provide the feedback control. However, an alternative is to use a microprocessor which converts the sensed currents to digital values, and derives a suitable signal for the gate of the transistor 26 in the digital domain. Thus, instead of the analog circuit, a digital signal processor or microprocessor may be used. Similarly, a controller in the form of a field programmable gate array may be used.

The transistor 26 is only one example of a control device for controlling the current flowing to the buffer capacitor. Another possible example is a switch mode power supply which is controlled using feedback to implement the desired current control. Any current regulating circuit may be used which is controlled by the controller to implement the desired control of the charging of the buffer capacitor.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting unit, comprising:

a light source;

a driver for driving the light source which provides an output current between first and second terminals;

a first current sensing element in series with the light source between the first and second terminals;

an auxiliary circuit for powering by the driver, which auxiliary circuit comprises a buffer capacitor;

a second current sensing element and a control switch in series with the buffer capacitor between the first and second terminals; and a controller adapted to control the control switch in dependence on the currents sensed by the first and second current sensing elements thereby to control the current flowing to the buffer capacitor.

2. A lighting unit as claimed in claim 1, comprising a current mirror circuit for comparing the currents through the first and second current sensing elements.

3. A lighting unit as claimed in claim 1, wherein the controller is adapted to control the current through the buffer capacitor during initial charging to be a fixed multiple of the current through the light source.

4. A lighting unit as claimed in claim 3, wherein the controller is adapted to control the current through the buffer capacitor during initial charging to be equal to the current through the light source.

5. A lighting unit as claimed in claim 3, which is adapted to switch on the control switch when the initial charging is complete.

6. A lighting unit as claimed in any claim 1, wherein the current sensing elements comprise current sense resistors.

7. A lighting unit as claimed in claim 1, wherein the control switch comprises a transistor, wherein the signal for the control terminal is provided by the controller.

8. A lighting unit as claimed in claim 1, wherein the buffer capacitor has a capacitance greater than 10 μF, for example greater than 100 μF, for example greater than 200 μF, for example greater than 400 μF.

9. A lighting unit as claimed in claim 1, wherein the driver comprises a protection system for shutting down in response to a detected driver output open circuit or short circuit condition.

10. A lighting unit as claimed in claim 1, wherein the driver comprises a switch mode power converter.

11. A method of driving a lighting unit, comprising:

using a driver to deliver an output current between first and second terminals;

sensing a portion of the output current through a light source of the lighting unit using a first current sensing element;

sensing a portion of the output current through a buffer capacitor of an auxiliary circuit using a second current sensing element; and controlling a control switch in series with the buffer capacitor in dependence on the currents sensed by the first current sensing element and the second current sensing element thereby to control the current flowing to the buffer capacitor, wherein the second current sensing element, the control switch and the buffer capacitor are connected in series between the first and second terminals.

12. A method as claimed in claim 11, comprising controlling the current through the buffer capacitor during initial charging to be a fixed multiple of the current through the light source.

13. A method as claimed in claim 12, comprising controlling the current through the buffer capacitor during initial charging to be equal to the current through the light source.

14. A method as claimed in claim 12, comprising switching on the control switch when the initial charging is complete.

15. A method as claimed in any one of claim 11, comprising providing protection for shutting down the driver in response to a detected driver output open circuit or short circuit condition.

* * * * *